United States Patent [19]

Asick et al.

[11] Patent Number: 4,490,000

[45] Date of Patent: Dec. 25, 1984

[54] MULTI-PLANE CROSSOVER CONTACT

[75] Inventors: John C. Asick, Harrisburg; John M. Landis, Camp Hill, both of Pa.

[73] Assignee: AMP Incorporated, Harrisburg, Pa.

[21] Appl. No.: 478,017

[22] Filed: Mar. 23, 1983

[51] Int. Cl.[3] ..... H01R 25/16

[52] U.S. Cl. ..... 339/17 LM; 339/17 M; 339/19; 339/155 R; 339/176 M

[58] Field of Search ..... 339/19, 222, 176 M, 339/17 M, 17 LM, 155 R

[56] References Cited

U.S. PATENT DOCUMENTS

| | | | |
|---|---|---|---|
| 2,701,346 | 2/1955 | Powell | 339/17 M |
| 2,904,768 | 9/1959 | Rasmussen | 339/17 LM |
| 3,193,787 | 7/1965 | McGhee | 339/17 LM |
| 3,206,648 | 9/1965 | Jordan et al. | 339/17 M |
| 3,404,367 | 10/1968 | Henschen | 339/217 S |
| 3,634,816 | 1/1972 | Zell | 339/186 M |
| 3,731,254 | 5/1973 | Key | 339/19 |
| 4,050,758 | 9/1977 | Curley | 339/176 M |
| 4,133,592 | 1/1979 | Cobaugh et al. | 339 17 M/ |
| 4,186,982 | 2/1980 | Cobaugh et al. | 339 17 C/ |
| 4,384,754 | 5/1983 | Dout et al. | 339/19 |

FOREIGN PATENT DOCUMENTS

| | | | |
|---|---|---|---|
| 0004422 | 10/1979 | European Pat. Off. | 339/176 M |

*Primary Examiner*—John McQuade
*Assistant Examiner*—Thomas M. Kline
*Attorney, Agent, or Firm*—Russell J. Egan

[57] ABSTRACT

A crossover contact for use in interconnecting circuits on pairs of adjacent parallel spaced circuit boards is formed by a folded over contact having two leg portions which are formed along axes which are parallel, the planes of the respective leg portions being stepped from each other. Thus the contact is able to engage pin terminals of a first row of a pin header and pin terminals of a second row of a pin shroud thereby bussing the two rows.

4 Claims, 6 Drawing Figures

MULTI-PLANE CROSSOVER CONTACT

The present invention relates to a bussing connector system for providing a pluggable interconnect between conductive planes of adjacent pairs of parallel spaced circuit boards and in particular to a terminal providing a crossover between adjacent rows of terminals.

The present invention relates to an improvement in the bussing connector system described in copending application Ser. No. 437,997 filed Nov. 1, 1982.

The prior art is represented by U.S. Pat. Nos. 3,404,367 and 3,634,816 both of which show a mother circuit board having a plurality of connector members attached thereto and a like plurality of daughter boards each having an edge connector received in a respective one of the mother circuit board connectors. U.S. Pat. No. 4,133,592 shows a connector for electrically and mechanically joining a plurality of circuit boards in a stack. This arrangement has a clear disadvantage in that boards towards the middle of the stack are not readily accessible. Such arrangements are not readily adaptable and have the obvious disadvantage that they must be initially designed into the equipment and then are rather fixed in configuration. They are generally rather expensive to install and maintain.

The present invention pertains to a connector system which can be used to selectively connect any number of pairs of adjacent parallel spaced circuit boards. The subject connector system includes a bussing connector for each pair of circuit boards and a connector assembly mounted on each circuit board. Each bussing connector has a housing of rigid insulative material with a plurality of parallel spaced apart profiled slots. Each slot includes a groove in each opposite face of the connector extending away from the mating face in parallel spaced fashion. The bussing connector has a plurality of receptacle terminals each mounted in a respective slot in the housing and each terminal having a crossbar portion and a pair of parallel spaced contact legs which lie in respective grooves. The present invention concerns the contact which lies in the groove of one slot on a first side of the connector and in the opposite groove of the next adjacent slot to provide a crossover interconnect between rows of terminals on the mating circuit board. The connector assembly on each circuit board includes a pin header and a pin shroud mounted on opposite sides of a mating edge portion of each circuit board. Each header and each shroud have a plurality of terminal passages extending therethrough, each aligned with a respective conductive aperture in the circuit board. A plurality of pin terminals extend through respective passages and conductive aperture of the circuit board to project from both oppositely directed mating faces of the header and shroud. The bussing terminals engage the pin terminals extending from the mating face of a pin header of a first circuit board and the pin terminals extending from the shroud of a second circuit board in a different row so that the circuits of the first and second boards are bussed together.

The present invention will be described by way of non-limiting example with reference to the accompanying drawings in which.

Figure 1:
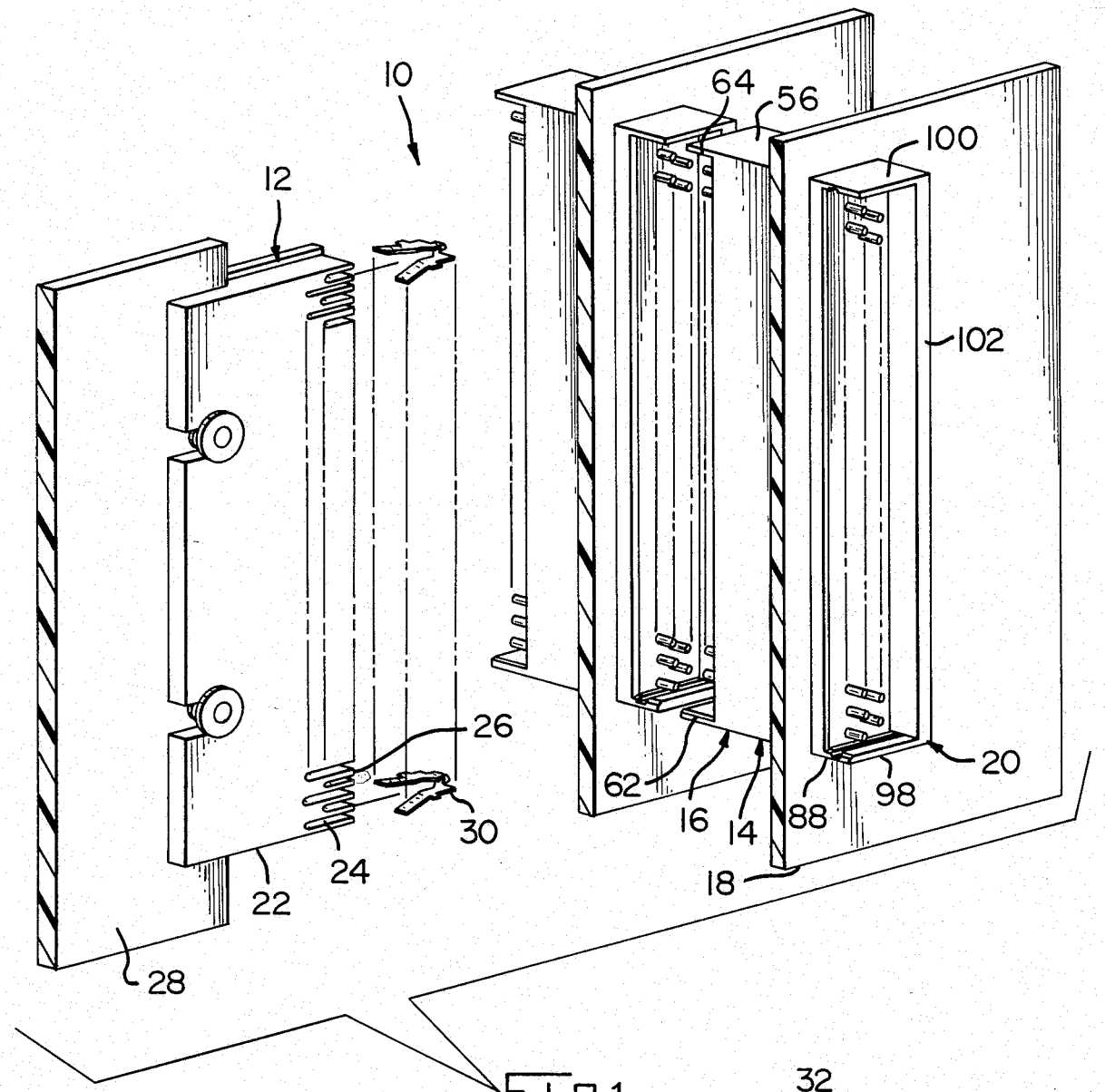
FIG. 1 is an exploded perspective view of the subject connector system according to the present invention.

The bussing system 10 is formed by a bussing connector 12, a pin connector assembly 14 formed by a pin header 16 mounted on a first side of a circuit board 18 and a pin shroud 20 mounted on a second opposite side of the circuit board 18.

Figure 2:
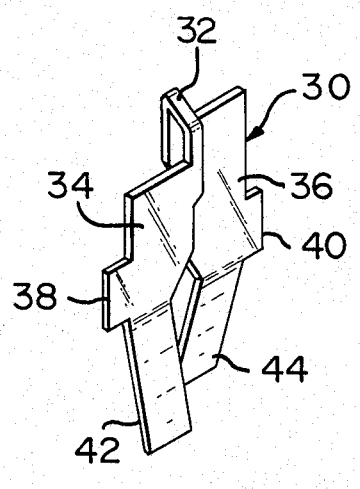
FIG. 2 is a perspective view of the crossover contact of the present invention.
Figure 4:
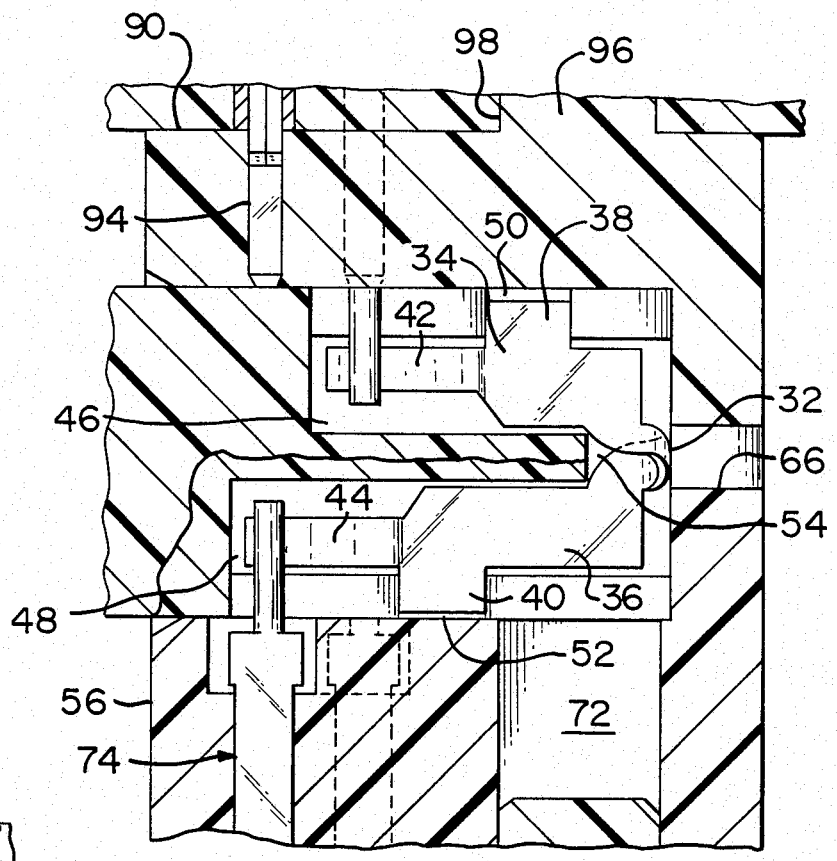
FIG. 4 is a section taken through the subject connector system in a mated condition.
Figure 5:
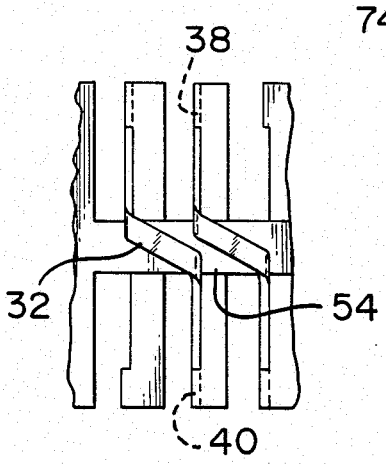
FIG. 5 is an end elevation of the bussing connector according to the present invention.
Figure 6:
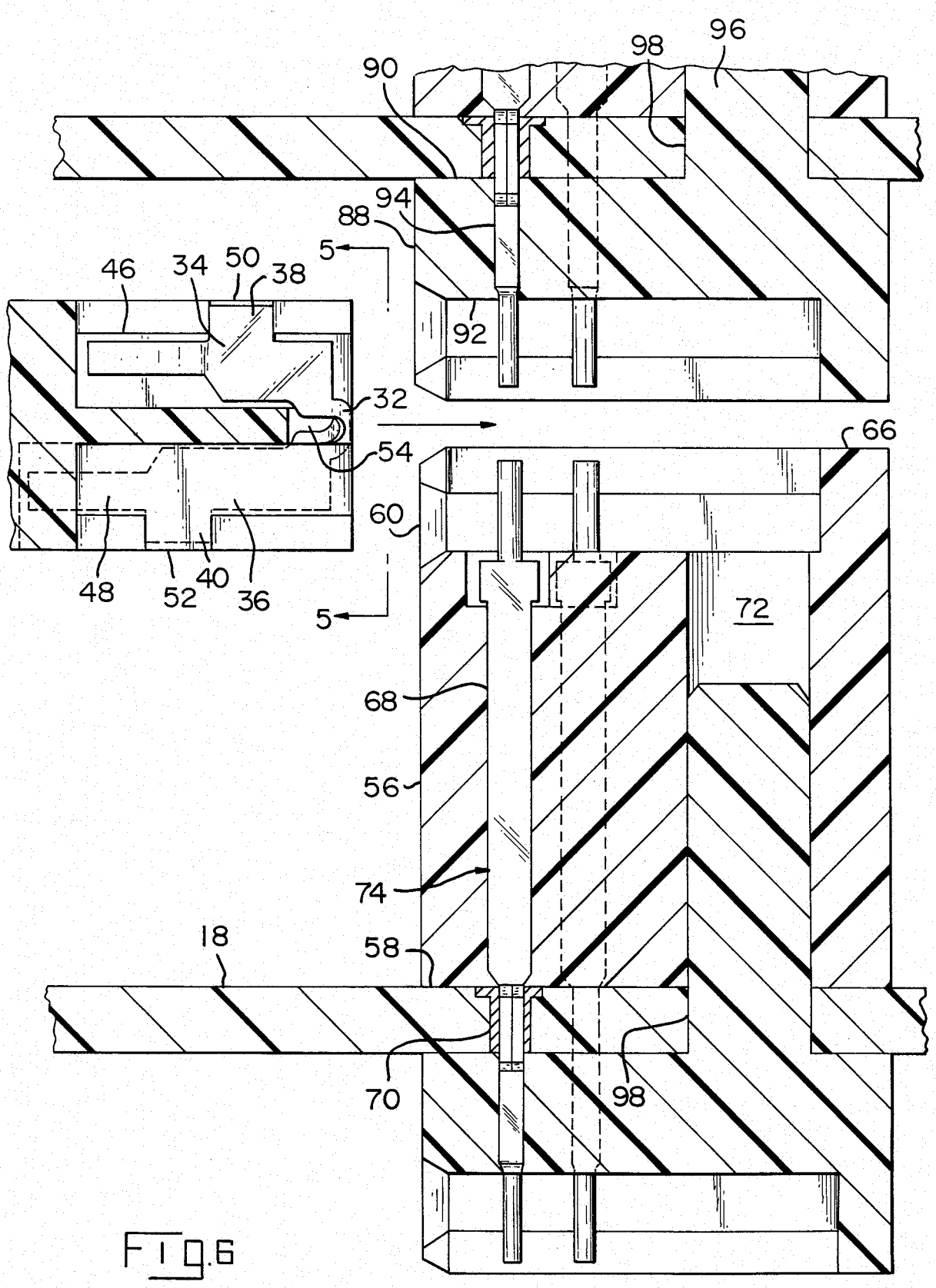
FIG. 6 is a section through the subject connector system in the unmated condition.

The bussing connector 12 has a housing 22 made of rigid insulative material defining a plurality of parallel spaced apart slots 24 extending inwardly from a mating face 26. The connector 12 has been shown in FIG. 1 mounted on a chassis 28. It is to be understood that this connector could be part of a handle or intercard connector or the like. A crossover contact 30, as best seen in FIG. 2, is mounted in each respective slot 24 of the bussing connector. Each terminal 30 has a crossbar portion 32 which is folded upon itself and has a pair of leg portions 34, 36 depending from opposite ends thereof with the axis of the leg portions being parallel and spaced apart. Each leg portion 34, 36 includes an outwardly directed lug 38, 40 and a blade 42, 44 canted with respect to the axis of the respective leg portion. The slots 24 are profiled, as best seen in FIGS. 4 and 6. Each slot 24 has a side groove 46, 48 extending in parallel spaced relationship on opposite sides of the connector 12 with each groove having a recess 50, 52 spaced from the mating face 26 and adopted to receive a respective lug 38, 40. The grooves 46, 48 are interconnected at the mating face by a slot 54. Each terminal 30 is mounted in a respective slot 24 in the manner shown in FIGS. 4 and 6 with legs 34, 36 extending the length of the respective grooves 46, 48, with the crossbar 32 lying in the slot 54, and the lugs 38, 40 lying in the respective recesses 50, 52.

Figure 3:
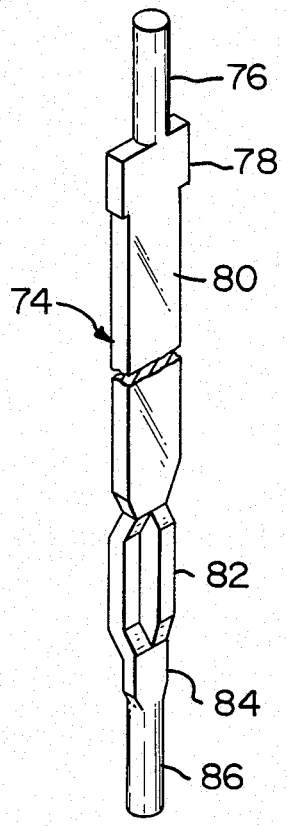
FIG. 3 is a perspective view of a pin terminal of the type used in the present invention.

Each pin header 16 has an elongated member 56 of rigid insulative material having a first printed circuit board engaging surface 58 and an oppositely directing mating face 60 enclosed on at least three sides by keyed end flanges 62, 64 and back flange 66. A plurality of terminal passages 68 extend between the surface 56 and face 60 and each is aligned with a respective conductive aperture 70 in circuit board 18. The header 16 also includes at least one mounting aperture 72 extending between the surface 58 and mating face 60. A terminal 74, as best seen in FIG. 3, is mounted in each respective passage 68 of the header 16 with each terminal 74 having a first pin portion 76, mounting shoulders 78, a first body portion 80, a compliant mounting portion 82, a second body portion 84, and a second oppositely directed pin portion 86. This terminal is preferably formed from flat stock with the compliant mounting portion 82 formed in the manner of U.S. Pat. No. 4,186,982, the disclosure of which is incorporated herein by reference.

Each terminal 74 is mounted in a respective passage 68 to help secure the header on the circuit board 18 by insertion of the compliant portion 82 of the terminal into the respective conductive holes 70 of the circuit board. It should be noted here that the pin portions 76, 86 can have any section shape, such as round, as shown, or square.

The pin shroud 20 is mounted from the opposite side of the circuit board 18. The shroud 20 is likewise an elongated member 88 of rigid insulative material having a circuit board contacting surface 90 and an oppositely directed parallel spaced mating face 92. A plurality of terminal passages 94 extend between surface and face 92. At least one mounting stud 96 extends normal to the surface 90. The mating face 92 is enclosed on three sides by keyed end walls 98, 100 and elongated back wall 102. The pin shroud 20 is mounted on the opposite side of the circuit board 18 from header 16 by applying it so that the second body 84 of the terminals 74 can extend through the respective passages 94 with the second pins 86 extending from the mating face 92. The mounting stud 96 passes through an aperture 98 in the circuit board 18 to engage in the mounting aperture 72 in the pin header with a frictional fit engagement.

The mounting of the header 16 and shroud 20 on opposite sides of the circuit boards 18 with a single pin terminal 74 extending through the header shroud and circuit board provides the circuit board with the capability of being bussed from both sides. The bussing connector can be inserted between the header of a first circuit board and a shroud of a second circuit board as shown in FIG. 6 to make bussing interconnection between the circuit boards. It will be noted that with the use of the stepping terminal of the present invention the pins of one row of a header or shroud will be interconnected with the pins of an adjacent row of the other of the pin header and shroud.

We claim:

1. A bussing system for interconnecting in stepped or crossover fashion circuits on pairs of adjacent parallel spaced circuit boards, comprising:

an elongated bussing connector having a housing of rigid insulative material defining a plurality of parallel spaced profiled slots inwardly directed from a mating face, each slot including a groove on each opposite side face of the connector extending away from the mating face, with planes defined by the grooves being parallel and stepped apart, and an oblique channel at said mating face connecting said grooves, a plurality of crossover terminals each mounted in a respective slot and each having a cross bar portion lying in said channel and a pair of parallel spaced contact legs lying in respective grooves; and a connector assembly on each circuit board comprising a pin header and a pin shroud mounted on opposite sides of a mating edge portion of each said circuit board, each said pin header and said pin shroud having a housing of rigid insulative material with a plurality of terminal passages extending therethrough, each passage aligned with a respective conductive aperture in said circuit board, a like plurality of pin terminals each extending through respective ones of said passages and conductive aperture to project from both oppositely directed mating faces of said pin header and pin shroud whereby crossover terminals of a bussing connector engaging the terminal pins extending from the mating face of a pin header of a first circuit board and a pin shroud of a second circuit board busses together the circuits of said first and second circuit boards.

2. A bussing system according to claim 1 wherein each said crossover terminal further comprises retention means to secure said terminal in a respective slot of said bussing connector housing.

3. In a bussing system for interconnecting in stepped or crossover fashion circuits on pairs of adjacent parallel spaced circuit boards, said system having an elongated bussing connector with a housing of rigid insulative material defining a plurality of parallel spaced profiled slots extending inwardly from a mating face, each slot including a groove extending on each side of the connector away from the mating face, with the planes defined by the grooves being in parallel spaced relation, and an oblique channel in said mating face interconnecting pairs of grooves, and a connector assembly on each circuit board having a pin header and a pin shroud mounted on opposite sides of a mating edge portion of the circuit board, each pin header and pin shroud having a housing of rigid insulative material with a plurality of terminal passages extending therethrough, each passage being in line with the respective conductive aperture in said circuit board, and a like plurality of pin terminals each extending through respective ones of the passages and conductive aperture to project from both oppositely directed mating faces of said pin header and said pin shroud, a crossover terminal mounted in each respective slot of the bussing connector characterized by a conductive member folded upon itself to form a bight with two leg portions, the axes of each are parallel, spaced apart and stepped from a plane defined by the other of said leg portions, said bight lying in said channel with each leg portion lying in a respective groove on opposite sides of said bussing connector in stepped fashion to engage a pin terminal of a first row on one of said pin header and pin shroud and a pin terminal of an adjacent row.

4. In a bussing system for interconnecting circuits on pairs of adjacent parallel spaced circuit boards, said system being formed by an elongated bussing connector housing of rigid insulative material having a mating face and defining a plurality of parallel spaced profiled slots, each slot including a groove on each opposite side face of the connector extending away from the mating face in parallel spaced fashion, a plurality of receptacle terminals each mounted in a respective slot and each having a cross bar portion and a pair of integral parallel spaced contact legs each leg lying in a respective groove; and a connector assembly on an edge portion of each circuit board having a pin header and a pin shroud mounted on opposite sides of an edge portion of each said circuit board, and a plurality of pin terminals passing through the circuit board to extend from mating faces of said pin header and said pin shroud characterized by each said pin header and said pin shroud being formed of rigid insulative material having a plurality of terminal passages extending therethrough between a circuit board engaging surface and an oppositely directed mating face, each passage aligned with a respective conductive aperture in said circuit board, said pin terminals each having a compliant mounting section intermediate two body portions, the former engaging in a respective conductive aperture and the latter extending through said passages in said pin header and said pin shroud, said terminal having end pin portions which project from both oppositely directed mating faces of said pin header and pin shroud whereby a bussing connector engaging the pins extending from the mating face of a pin header of a first circuit board and a pin shroud of a second circuit board busses together the circuits of the first and second circuit boards, a means for providing crossover or stepped connection between circuits of adjacent circuit boards comprising:

a like plurality of oblique channels in the mating face of said bussing connector interconnecting a groove in one row on one side of said connector with the next stepped groove on the next row on the other side of said connector, and each said cross bar portion of each said receptacle terminal lying in each respective channel with the legs lying in stepped grooves on each side of the connector.

* * * * *